US011137126B2

(12) United States Patent
Cao

(10) Patent No.: US 11,137,126 B2
(45) Date of Patent: Oct. 5, 2021

(54) PROJECTOR-TYPE VEHICLE HEADLAMP

(71) Applicant: Lumileds LLC, San Jose, CA (US)

(72) Inventor: Yiyu Cao, Shanghai (CN)

(73) Assignee: Lumileds LLC, San Jose, CA (US)

( * ) Notice: Subject to any disclaimer, the term of this patent is extended or adjusted under 35 U.S.C. 154(b) by 97 days.

(21) Appl. No.: 16/471,459

(22) PCT Filed: Dec. 13, 2017

(86) PCT No.: PCT/EP2017/082550
§ 371 (c)(1),
(2) Date: Jun. 19, 2019

(87) PCT Pub. No.: WO2018/114506
PCT Pub. Date: Jun. 28, 2018

(65) Prior Publication Data

US 2021/0131635 A1 May 6, 2021

(30) Foreign Application Priority Data

Dec. 21, 2016 (WO) ..... PCT/CN2016/111266
Jan. 16, 2017 (EP) ..... 17151592

(51) Int. Cl.
*F21S 41/33* (2018.01)
*F21S 41/151* (2018.01)
*F21S 41/147* (2018.01)

(52) U.S. Cl.
CPC ..... *F21S 41/33* (2018.01); *F21S 41/147* (2018.01); *F21S 41/151* (2018.01)

(58) Field of Classification Search
CPC ..... F21S 41/33; F21S 41/147; F21S 41/151
See application file for complete search history.

(56) References Cited

U.S. PATENT DOCUMENTS 7,097,334 B2 8/2006 Ishida et al.
7,735,574 B2 7/2010 Meyrenaud
(Continued)

FOREIGN PATENT DOCUMENTS

CN 1456837 A 11/2003
CN 102016397 A 4/2011
(Continued)

OTHER PUBLICATIONS

EPO as ISA, PCT/EP2017/082550 filed Dec. 13, 2017, "International Search Report and Written Opinion", dated Mar. 19, 2018, 12 pages.

(Continued)

*Primary Examiner* — Thomas M Sember

(57) ABSTRACT

A projector-type vehicle headlamp not having a physical shade is disclosed. The vehicle headlamp comprises a first light source for emitting light, a lens through which the light exits the headlamp, and a first optics for receiving light from the first light source and directing the received light towards the lens, with the lens having a focal surface between the first optics and the lens, and with the lens having an optical axis. The first optics is configured to generate multiple images of the first light source on the focal surface above an intersection line of the focal surface with a reference plane, with the reference plane containing the optical axis of the lens, and with the reference plane enclosing an angle in the range of 0-45 degree with a horizontal plane when the headlamp is installed in a vehicle. The first optics is a curved reflector with an elliptical side edge.

10 Claims, 7 Drawing Sheets

(56) References Cited

U.S. PATENT DOCUMENTS

| | | | | |
|---|---|---|---|---|
| 3,585,261 | A1 | 11/2013 | Schug | |
| 3,476,561 | A1 | 10/2016 | Yamamura et al. | |
| 2003/0202359 | A1* | 10/2003 | Albou ..... | F21S 41/43<br>362/514 |
| 2004/0240223 | A1 | 12/2004 | Brun et al. | |
| 2007/0247863 | A1 | 10/2007 | Liou | |
| 2013/0039085 | A1 | 2/2013 | Iwasaki et al. | |

FOREIGN PATENT DOCUMENTS

| | | | |
|---|---|---|---|
| CN | 102954419 | A | 3/2013 |
| CN | 104412035 | A | 3/2015 |
| CN | 106195862 | A | 12/2016 |
| EP | 1433999 | A1 | 6/2004 |
| EP | 1672272 | A2 | 6/2006 |
| EP | 1881264 | A1 | 1/2008 |
| EP | 1988330 | A1 | 11/2008 |
| EP | 2390562 | A2 | 11/2011 |

OTHER PUBLICATIONS

Extended European Search Report dated Aug. 2, 2017, European Application No. 17151592.7, 8 pages.

* cited by examiner

PROJECTOR-TYPE VEHICLE HEADLAMP

CROSS-REFERENCE TO RELATED APPLICATIONS

The present application is a § 371 application of International Application No. PCT/EP2017/082550 filed on Dec. 13, 2017 and titled "PROJECTOR-TYPE VEHICLE HEADLAMP", which claims the benefit of International Application No. PCT/CN2016/111266 filed on Dec. 21, 2016 and European Patent Application No. 17151592.7 filed on Jan. 16, 2017. International Application No. PCT/EP2017/082550, International Application No. PCT/CN2016/111266, and European Patent Application No. 17151592.7 are incorporated herein.

FIELD OF THE INVENTION

The invention generally relates to a vehicle headlamp, and particularly to a projector-type vehicle headlamp that does not use a physical shade.

BACKGROUND OF THE INVENTION

Generally speaking, a typical conventional vehicle headlamp at least comprises a light source 1, an aspherical collimating lens 2 and a movable shade 3, as shown in FIG. 1. The movable shade 3 is typically driven by a motor via a mechanical device, and it acts as an essential component to achieve a low beam (passing beam) and high beam (driving beam) for the vehicle such as a car. In low beam mode, the shade 3 is worked to block part of light emitted from the light source 1 to form a cut-off line which can remove glare to human eyes, the low beam generated is therefore more comfortable and safer to the drivers who come from the front. When the vehicle headlamp is in a high beam mode, the shade 3 may be lowered or removed such that all the light from light source 1 can be projected out to enhance the lighting performance for an exterior environment.

Consequently, in the prior art, the physical shade 3 behind the collimating lens 2 is required so that the cut-off line for the low beam can be shaped accordingly. However, the physical shade 3 may also give rise to some problems for the vehicle headlamp. For example, due to the shade being commonly driven by mechanical devices which have more risk of unexpected failure, vehicle headlamps may have less effective operating life, and the shade therefore e.g. may create an unexpected cut-off line for the high beam. Moreover, the physical shade blocking part of the light emitted from the light source may result in a lower utility rate of light.

EP1672272A2 disclosed generating an intermediate image of an extended light source within a focal plane of a projection lens and above a horizontal plane containing the lens' optical axis for generating a beam with an upper bright/dark cut-off EP2390562A2 proposed to image by a reflector a flat light emitter into a plane comprising the emitter, there forming a hot spot limited by a control curve, and the hot spot then projected by a lens onto the road for forming a cutoff beam without the use of a physical shade.

Still, there is a need to provide an improved vehicle headlamp to mitigate or avoid the problems caused by the physical shade in the headlamp.

SUMMARY OF THE INVENTION

A general objective of the embodiments of present invention is to provide a projector-type vehicle headlamp not having a physical shade, so as to eliminate or at least mitigate the above-mentioned problems.

According to an embodiment of the invention, the proposed projector-type vehicle headlamp comprises a first light source for emitting light, a lens through which the light exits the headlamp, and a first optics for receiving light from the first light source and directing the received light towards the lens, with the lens having a focal surface between the first optics and the lens, and with the lens having an optical axis. The first optics is configured to generate multiple images of the first light source on the focal surface above an intersection line of the focal surface with a reference plane, with the reference plane containing the optical axis of the lens, and with the reference plane enclosing an angle $\alpha$ in the range of 0-45 degree with a horizontal plane when the headlamp is installed in a vehicle.

For the projector-type vehicle headlamp provided by this embodiment, the conventional physical shade can be eliminated from the vehicle headlamp without affecting the normal low beam function of the headlamp, such vehicle headlamp is designed based on the principle of reversibility of light. In particular, the first optics is designed such that multiple images of the first light source are generated on the focal surface above the intersection line of the focal surface as described above when the headlamp is installed in a vehicle. In this way, when the headlamp is installed in the vehicle, a low beam can be generated from the headlamp without requiring a physical shade. Therefore, a simpler structure of the vehicle headlamp and a higher utility rate of light can be achieved.

The first light source may be any suitable light device including but not limited to a light emitting diode (LED). The first optics is a reflector.

The reflector comprises a curved reflecting surface having, as seen when the headlamp is installed in the vehicle, an upper edge, a lower edge, and a side edge connecting the upper edge and the lower edge, and a light emitting surface of the first light source confronts the curved reflecting surface of the reflector.

The side edge is a portion of an ellipse. With the side edge being a portion of an ellipse, the shape of the side edge is relatively easy to design, and the model of the reflecting surface for the reflector can be easily determined by sweeping a spline along the designed side edge of an ellipse shape.

In some embodiments, the first light source is located at a first focal point of the ellipse, and a second focal point of the ellipse is located between the focal surface and the lens.

In some embodiments, the first focal point of the ellipse is located in the middle of an edge of the light emitting surface of the first light source, which edge is the edge of the light emitting surface being closest to the focal surface.

In some embodiments, the headlamp further comprises a second light source and a second optics, these two being configured to direct light from the second light source via the second optics towards a focal point of the lens within the focal surface and on the optical axis. In this way, a bi-functional headlamp that can generate both low beam and high beam is achieved.

In some embodiments, a light emitting surface of the second light source confronts the second optics, and as seen along a vertical direction when the headlamp is installed in the vehicle, the second light source is arranged to be farer away from the first optics than the first light source. Such an arrangement of the components of the headlamp may enable the second light source not to block the light from the first light source and the light reflected from the reflector.

In some embodiments, the first light source is arranged outside of the paths traversed by the light from the second light source via the second optics to the lens. In this way, it is possible that the first light source will not block light from the second light source.

BRIEF DESCRIPTION OF THE DRAWINGS

These and other aspects, features and advantages of the present invention will be further explained by the following description of one or more embodiments with reference to the drawings, in which.

DETAILED DESCRIPTION OF EMBODIMENTS

Figure 1:
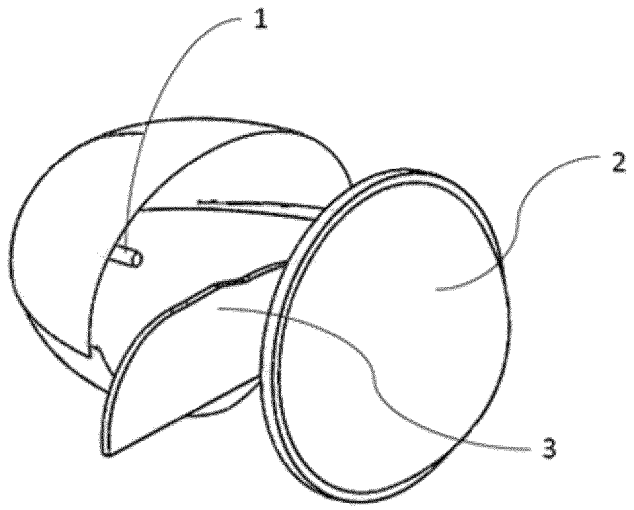
Fig 1. Prior Art
FIG. 1 illustrates a prior art vehicle headlamp having a physical shade.

Reference will now be made in detail to the present embodiments of the invention, examples of which are illustrated in the accompanying drawings. Wherever possible, the same reference numbers are used in the drawings and the description to refer to the same or like parts.

Figure 2:
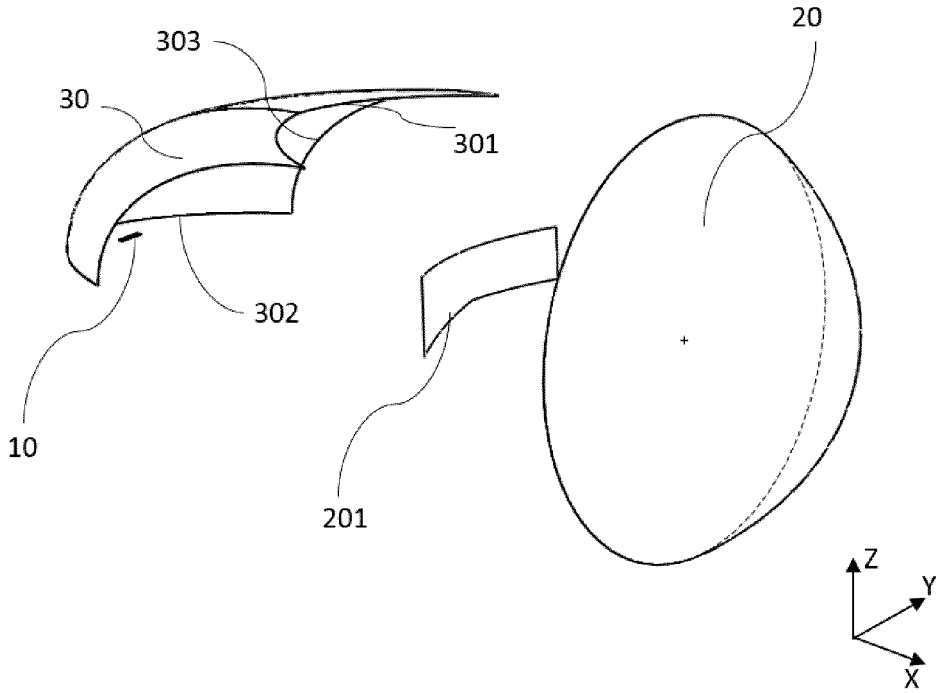
FIG. 2 illustrates a perspective view of a vehicle headlamp according to an embodiment of the invention when it is installed in a vehicle.

FIG. 2 illustrates a perspective view of a projector-type vehicle headlamp according to an embodiment of the invention, which comprises a first light source 10 for emitting light, a lens 20 through which the light exits the headlamp, and a first optics 30 for receiving light from the first light source 10 and directing the received light towards the lens 20. The lens 20 has a focal surface 201 between the first optics 30 and the lens 20, and the lens 20 also has an optical axis (not shown in the figure). When the headlamp is installed in a vehicle, the first optics 30 is configured to generate multiple images of the first light source 10 on the focal surface 201 above an intersection line of the focal surface 201 with a reference plane, with the reference plane containing the optical axis of the lens 20 and with the reference plane enclosing an angle $\alpha$ in the range of 0-45 degree with a horizontal plane.

Figure 3:
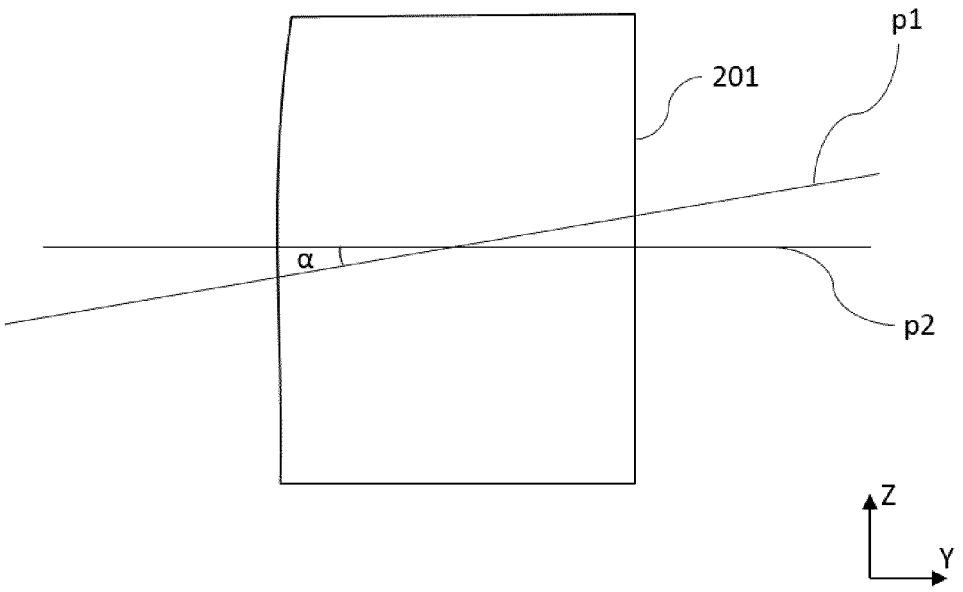
FIG. 3 illustrates the relationship between the focal surface 201 shown in FIG. 2 and a possible reference plane.

In order to achieve a clearer understanding for the above mentioned reference plane, FIG. 3 illustrates the relationship between the focal surface 201 and the reference plane. Referring to FIG. 3 in connection with FIG. 2, on the plane defined by the Y-axis and the Z-axis in FIG. 3, two possible reference planes p1, p2 intersecting with the focal surface 201 are shown. In this example, the reference sign p2 also denotes a horizontal plane, i.e., reference plane p2 encloses an angle of 0 degree with the horizontal plane, while the reference plane p1 encloses an angle $\alpha$ not more than 45 degree with the horizontal plane. It can be appreciated that any reference plane is feasible as long as it encloses an angle $\alpha$ in the range of 0-45 degree with the horizontal plane p2.

Figure 4:
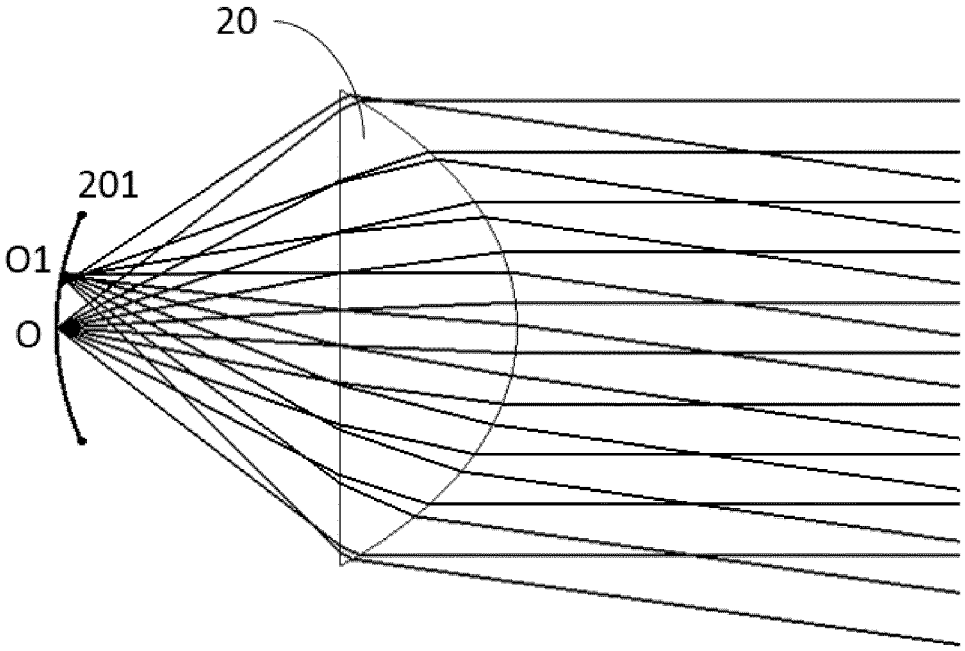
FIG. 4 illustrates a light path from a light source through a collimating lens to explain the principle of reversibility of light.

The embodiment of the invention actually utilizes the principle of reversibility of light. It is easy to be understood that for a lens such as the lens 20 shown in FIG. 4, parallel light rays from infinite distance towards the lens 20 can be concentrated on the focal surface 201. In particular, with the parallel light rays in the horizontal direction, they would be focused into a single focus point O by the lens 20. Parallel light rays in another direction would be focused to another point on the focal surface 201. For example, the tilted parallel light rays as shown in FIG. 4 towards the lens 20 would be concentrated to another point O1 above the point O. Consequently, based on the principle of reversibility of light, if a light source is placed at positions such as the points O and O1 shown in FIG. 4, light will pass and exit the lens along the light path shown in FIG. 4. In particular, light emitted from a light source at a position above the point O would be projected only downwards.

As to the vehicle headlamp provided by the embodiments of the invention, the images of the first light source 10 on the focal surface 201 generated by the first optics 30 may be deemed as virtual light sources. Since these images of the first light source 10 are above the intersection line as described above, at least part of the light exiting the lens 20 will be in the downwards direction. In this way, a low beam may be created without any physical shade in the headlamp. In addition, when assembling the headlamp into a vehicle such as a car, or during the commissioning of the vehicle headlamp, the relative positions of the first optics 30 and the lens 20 may be adjusted slightly, e.g., the lens 20 may be elevated or pulled down to some extent, so as to achieve a desired low beam from the headlamp.

Considering the 45 degree tilt cut-off line specified by some industry standards, the reference plane in these embodiments is selected to enclose an angle $\alpha$ in the range of 0-45 degree with a horizontal plane. In particular, in some embodiments, the reference plane may be selected to enclose an angle $\alpha$ in the range of 0-15 degree with a horizontal plane, since the tilt for the cut-off line is required to be less than 15 degree according to the industry standards in some countries.

Figure 5:
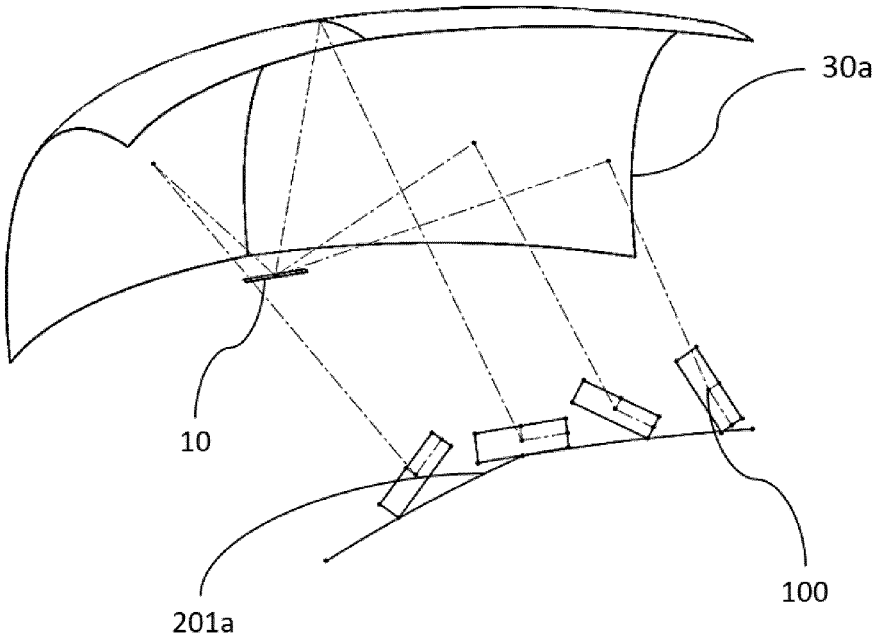
FIG. 5 illustrates images of the first light source generated by the first optics above an intersection line on the focal surface.

It can be appreciated that the focal surface 201 of the lens 20 may be a curved surface, so the intersection line of the focal surface 201 with a reference plane is not necessarily a straight line. To have a better understanding of the images of the light source generated by the first optics 30, FIG. 5 schematically shows a light source 10 such as a LED, the first optics 30, an intersection line 201*a* on the focal surface 201 and images 100 of the first light source 10 generated by the first optics 30. The light emitted from the first light source 10 is received by a point 30*a* on the first optics 30 and then directed towards the lens 20. Moreover, the first optics 30 is constructed to generate multiple images 100 of the first light source 10 on the focal surface 201 above an intersection line 201*a* of the focal surface 201 with a reference plane. It should be understood that such illustration of FIG. 5 is just used for facilitating the understanding of the intersection line described herein and the images of the first light source, rather than limiting the invention.

Therefore, with the projector-type vehicle headlamp provided by the embodiments of the invention, the physical shade as well as related devices to control this shade in the conventional headlamp can be omitted, and the structure of the vehicle headlamp can be simplified. Also, a higher utility rate of light may be achieved since there is no physical shade to block the light emitted from the light source.

In the following, an exemplary implementation for the first optics 30 will be described by way of example.

Referring to FIG. 2 again, the first optics 30 is a reflector. The reflector comprises a curved reflecting surface having, as seen when the headlamp is installed in the vehicle, an upper edge 301, a lower edge 302 and a side edge 303 connecting the upper edge 301 and the lower edge 302. Moreover, a light emitting surface of the first light source 10 confronts the curved reflecting surface of the reflector.

Figure 6:
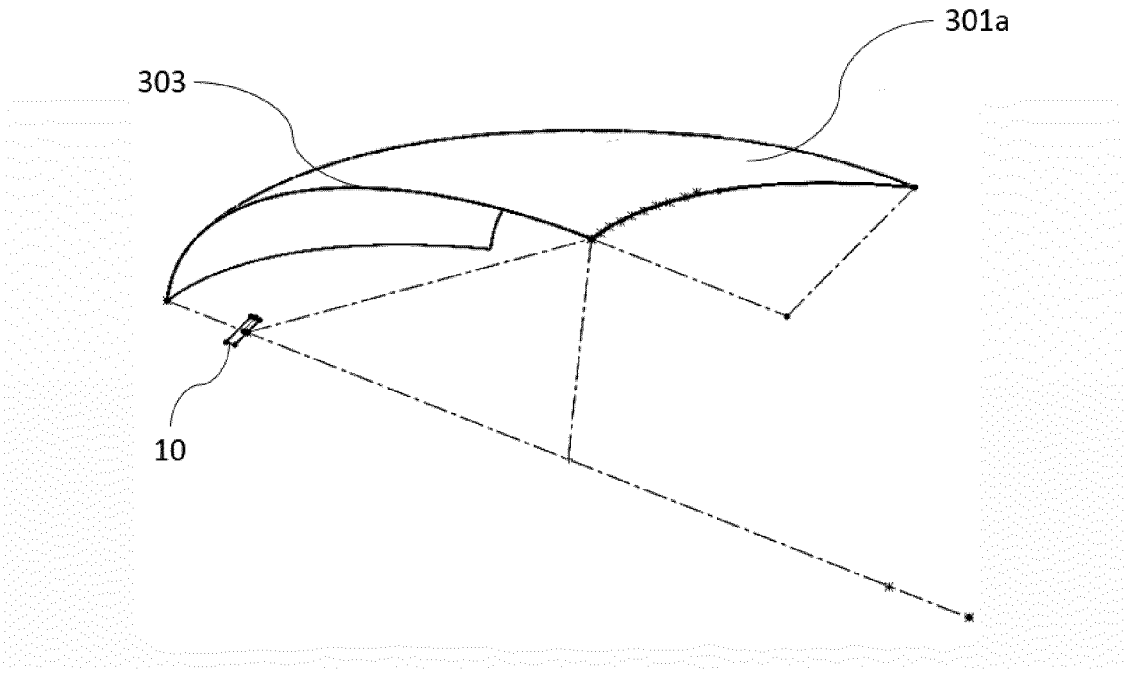
FIG. 6 illustrates a profile of a reflector according to an embodiment of the invention.

The side edge 303 of the curved reflecting surface is a portion of an ellipse. FIG. 6 illustrates a profile of the reflector with a side edge 303, which is a portion of an ellipse. FIG. 6 also shows a spline 301*a* of the upper edge of the reflector. Once the ellipse for the side edge 303 and the spline 301*a* are designed, the reflecting surface of the reflector may be determined by sweeping the spline 301*a* along the side edge 303. Thus the model of the reflector can be easily designed.

Next, an exemplary design of the ellipse for the side edge 303 and the spline 301*a* will be discussed in detail by way of example with reference to FIG. 7 and FIG. 8.

Figure 7:
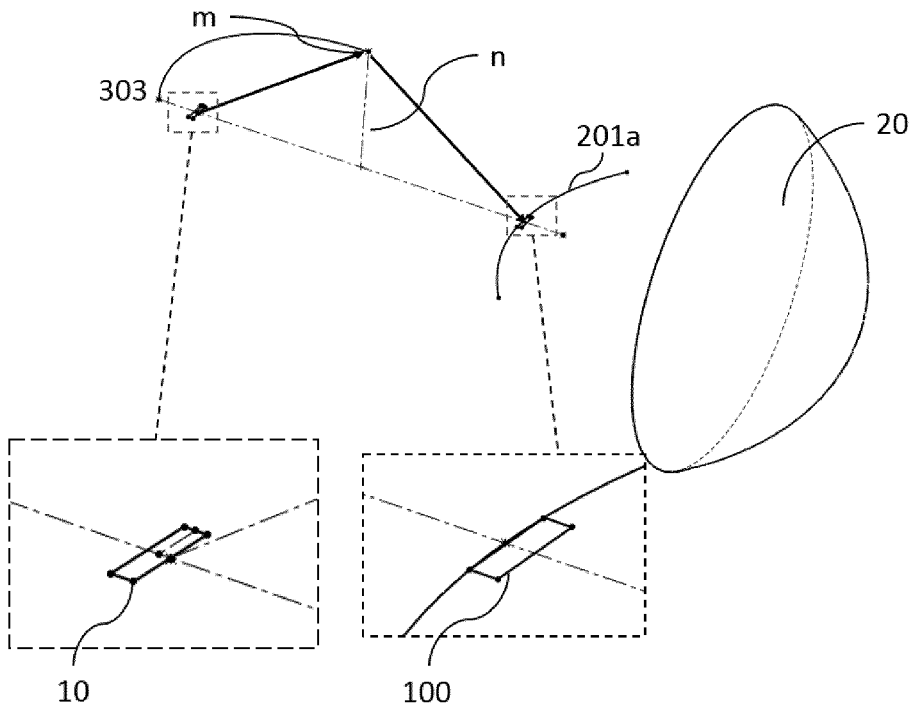
FIG. 7 schematically shows the process of generating an image of the first light source by the first optics being a reflector.

FIG. 7 schematically shows the process of generating an image 100 of the first light source 10 by the first optics being a reflector. The side edge 303 of the curved reflecting surface is a portion of an ellipse. The intersection line 201*a* on the focal surface is shown on a horizontal plane. Assuming that point m shown in FIG. 7 is the upmost point of the side edge 303, hence, for the lens 20, the point m can be deemed as a light incident point. Therefore, the normal n of the reflecting surface at the light incident point m will be in a vertical direction. On condition that the image 100 of the first light source 10 mirrored to the horizontal plane is of the same size as the first light source 10, then in this embodiment, the first light source 10 is located at a first focal point of the ellipse, and a second focal point of the ellipse is designed to be close to the intersection line 201*a* but located between the focal surface 201 of the lens 20 and the lens 20. That is to say, the second focal point of the ellipse is at the right side of the intersection line 201*a* in FIG. 7. It can be appreciated that light coming from the left side of the intersection line 201*a* in FIG. 7 and passing below the intersection line 201*a* would be projected upwards by the lens 20. Therefore, it is desired that light directed by the reflector pass above the intersection line 201*a* in FIG. 7 to achieve a low beam. This is the reason why the second focal point of the ellipse is designed to be located between the focal surface 201 of the lens 20 and the lens 20. In this way, the ellipse for the side edge 303 can be determined based on the designed first focal point and the second focal point.

More specifically, in some embodiments, the first light source 10 may be a LED, which may typically have a relatively regular light emitting surface, in this case, the first focal point of the ellipse may be located in the middle of an edge of the light emitting surface of the first light source 10, which edge is the edge of the light emitting surface being closest to the focal surface 201, as shown in FIG. 7.

As to the spline 301*a*, it can be designed through the following steps.

Step 1: As shown in FIG. 8, starting from the first light source 10, draw many lines L to the intersection line 201*a*. From the middle points of each line L, draw normal lines m' that are perpendicular with these lines L. Then the images 100 of the first light source 10 would be at the end of these lines L, symmetrical with the first light source 10 by the normal lines m'.

Step 2: Adjust the direction and length of the lines L, so that the images 100 are located at the right side of the intersection line 201*a* in FIG. 8, and their distance to the intersection line 201*a* is minimized.

Step 3: Connect the middle points of the adjusted lines L to construct a spline as the path p.

As the above conditions can predict, all light reflected by the reflector will pass above the intersection line 201*a* and hence be projected downwards by the collimating lens 20. Some of the rays may be very near the intersection line but won't cross to the below of the intersection line. Therefore a cut-off line may be achieved in the far field.

Figure 8:
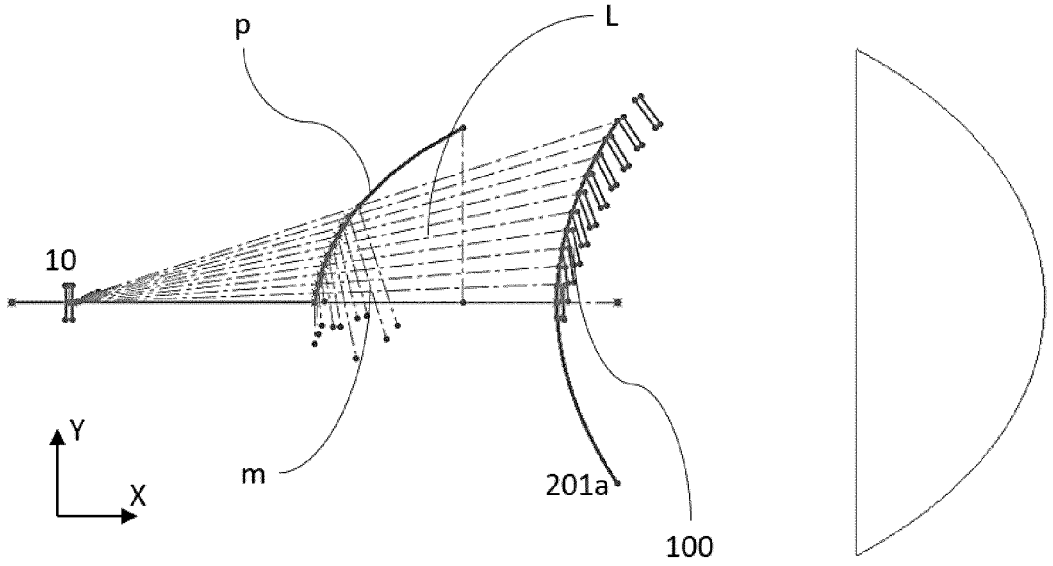
FIG. 8 illustrates a step of designing the spline for a reflector according to an embodiment of the invention.

FIG. 8 and the above steps described are just intended to describe the design method of the spline by way of example, and the specific design process may be performed by means of any appropriate computer software.

Since the shape of the ellipse for the side edge 303 is determined, and the spline 301*a* of the upper edge is designed, the complete curved reflecting surface of the reflector may be obtained by sweeping the spline as a path p along the side edge 303. That is to say, many splines may be duplicated along the side edge 303 to achieve a model of the reflector.

It should be understood that FIGS. 6-8 and the corresponding description just provide an exemplary first optics 30 being a reflector and a design process thereof, so the first optics 30 is not limited to this. Other forms of reflectors may be designed without departing from the spirit and scope of the invention.

Figure 9:
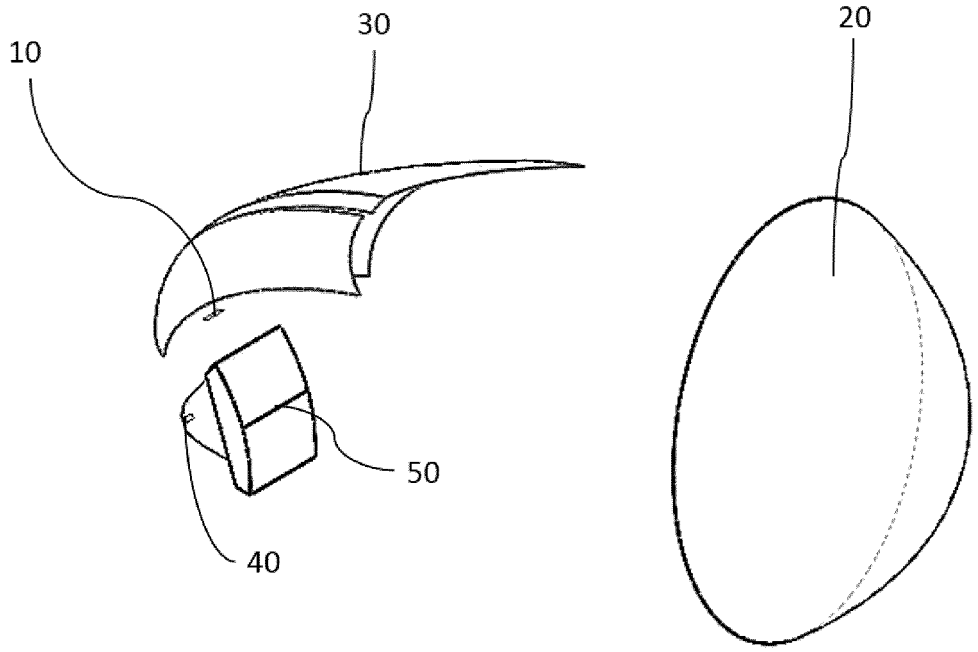
FIG. 9 illustrates a bi-functional vehicle headlamp according to another embodiment of the invention.

For the above described embodiments, the projector-type vehicle headlamp may only operate in a low beam mode. In order to achieve a bi-functional vehicle headlamp that can operate both in a high beam mode and a low beam mode, the projector-type vehicle headlamp according to another embodiment of the invention further comprises a second light source 40 and a second optics 50, which are configured to direct light from the second light source 40 via the second optics 50 towards a focal point of the lens 20 within the focal surface 201 and on the optical axis of the lens 20, as shown in FIG. 9.

The first light source 10 and the second light source 40 may comprise but are not limited to a LED, and they may be controlled by a controller to be independently switched on and off. For example, when only the first light source 10 is turned on, all the light exiting the lens 20 or most of the light exiting the lens 20 will be in a downwards direction due to the function of the first optics 30, thus a low beam can by created by the vehicle headlamp. Alternatively, only the second light source 40 can be controlled to be turned on, and a light beam in an upwards direction and in a horizontal direction may be projected from the lens 20 by means of a proper arrangement of the second light source 40 and the second optics 50.

Figure 10:
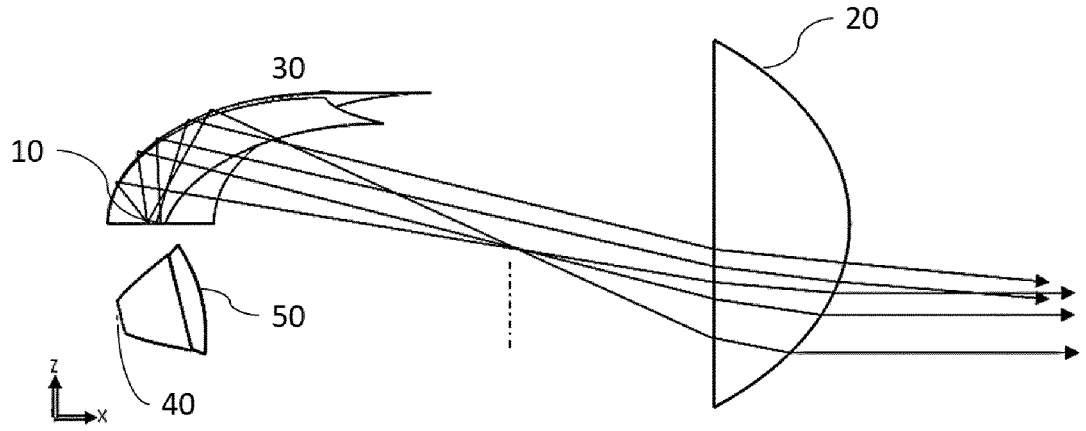
FIG. 10 and FIG. 11 respectively illustrate the light path from the first light source and the second light source towards the lens 20 for the headlamp shown in FIG. 9.
Figure 11:
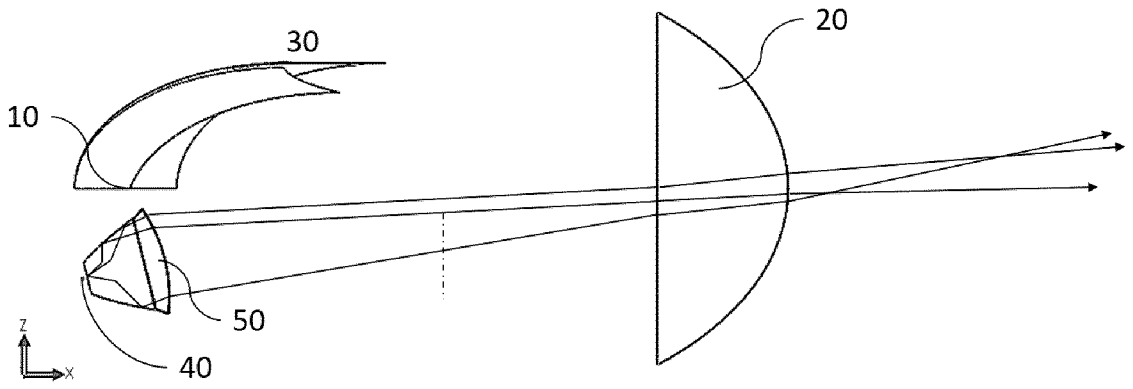

FIG. 10 and FIG. 11 respectively illustrate the light path from the first light source 10 and the second light source 40 towards the lens 20.

In some embodiments, a light emitting surface of the second light source 40 confronts the second optics 50. And as seen along a vertical direction when the headlamp is installed in the vehicle, the second light source 40 is arranged to be farer away from the first optics 30 than the first light source 10, as can be seen from FIGS. 9-11. In this way, it is not likely that the second light source 40 will block the light from the first light source 10 and the light reflected from the reflector. In other words, the risk of blocking the light from the first light source 10 and the light reflected from the reflector by the second light source 40 may be reduced to a low level. The uniformity of the light exiting the lens 20 may be improved due to the absence of light blocking, and the utilization rate of the light may also be enhanced.

In another embodiment, the first light source 10 is arranged outside of the paths traversed by the light from the second light source 40 via the second optics 50 to the lens 20. This embodiment may be illustrated in FIG. 11. With such an arrangement of the first light source 10, it may be enabled that the first light source 10 will not block the light from the second light source 40. Therefore, the high beam generated from the second light source 40 and the second optics 50 will not be blocked by the first light source 10. In fact, in the embodiment as shown in FIG. 11, the generated high beam will not be blocked by any entity in the vehicle headlamp, thus a more homogeneous high beam may be achieved, and the utilization rate of light from the second light source 40 may be improved.

Figure 12:
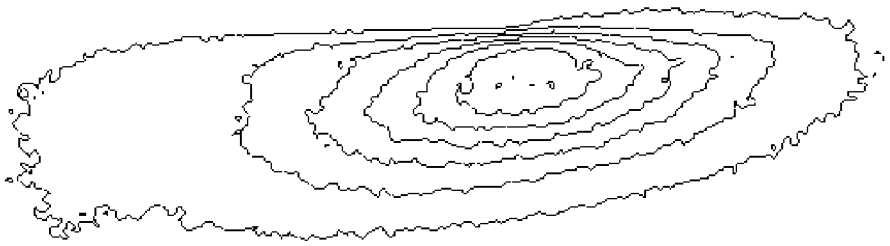
FIGS. 12 to 14 respectively show the light distribution pattern for the low beam and the high beam for the vehicle headlamp as shown in FIG. 9 by virtue of simulation.
Figure 13:
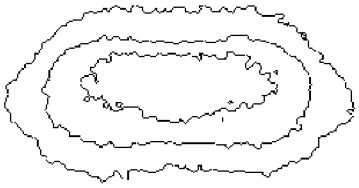

FIG. 12 and FIG. 13 respectively show the light distribution pattern for the low beam and the high beam for the vehicle headlamp as shown in FIG. 9 by virtue of simulation. From FIG. 12, it can be seen that a clear cut-off was formed in the low beam light distribution pattern. The cut-off is generated by virtual images that are created by the first optics 30 being a reflector on the focal surface 201 of the lens 20, which are then projected out onto the road. Moreover, as there is no physical shade in the vehicle headlamp, the light distribution pattern for the high beam can be achieved easily with the second light source 40 plus the second optics 50 as shown by FIG. 13.

Figure 14:
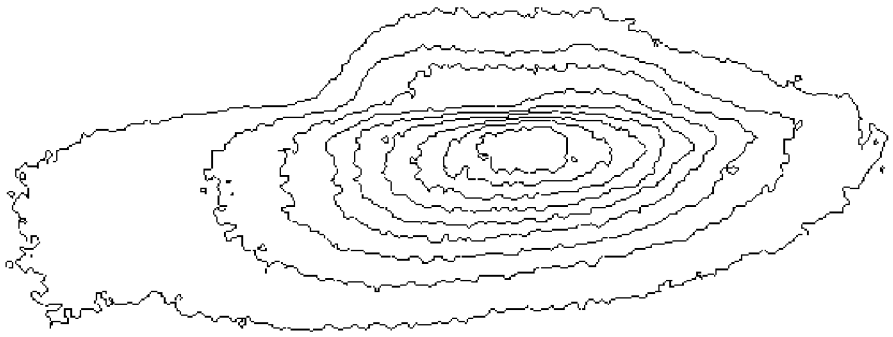

FIG. 14 shows the simulated light distribution pattern when both the first light source 10 and the second light source 40 are turned on. In this case, the first light source 10 and the second light source 40 are used for generating a driving beam to obtain an enhanced lighting performance for an exterior environment. As can be seen from FIG. 14, the transition of the beam shape between the two light sources 10, 40 is smooth, as there is no physical shade in the vehicle headlamp to interfere with the light distribution.

Although some exemplary embodiments of the invention have been described in the above description, other variations to the disclosed embodiments can be understood and effected by those skilled in the art in practicing the claimed invention from a study of the drawings, the disclosure, and the appended claims. In the claims, the word "comprising" does not exclude other elements or steps, and the indefinite article "a" or "an" does not exclude a plurality. Even if certain features are recited in different dependent claims, the present invention also relates to an embodiment comprising these features in common. Any reference signs in the claims should not be construed as limiting the scope.

LIST OF REFERENCE SIGNS

1 prior art light source
2 prior art collimating lens
3 prior art physical shade
10 first light source
20 lens
30 first optics
30*a* point on reflecting surface of first optics 30
40 second light source
50 second optics
100 images of first light source 10 on focal surface 201 of lens 20
201 focal surface of lens 20
201*a* intersection line of reference plane with horizontal plane on focal surface 201 of lens 20
301 upper edge of first optics 30
301*a* spline to generate reflecting surface of reflector of first optics 30
302 lower edge of first optics 30
303 side edge of first optics 30
α angle of reference plane to horizontal plane
L connecting lines from first light source 10 to intersection line 201*a*
m upmost point of the side edge 303 of first optics 30
m' lines normal to and at the middle points of lines L
n normal of the reflecting surface at the light incident point m
O, O1 focal points of lens 20 for parallel rays from infinite distance
p path for construction of spline 301*a*
p1, p2 reference planes
X, Y, Z directions of 3-dimensional space

The invention claimed is:

1. A projector-type vehicle headlamp, comprising:

a first light source configured to emit a light from a light emitting surface;

a reflector comprising a curved reflecting surface facing the light emitting surface of the first light source and having an upper edge, a lower edge, and a side edge connecting the upper edge and the lower edge, the side edge being part of an ellipse having a first focal point intersecting the first light source, and a lens having a lens focal surface between the reflector and the lens and having an optical axis that is comprised in a reference plane, the reference plane having an angle in a range of 0-45 degrees with respect to a horizontal plane, the lens focal surface comprising an intersection line where the lens focal surface intersects the reference plane;

the reflector being configured to receive and direct the light from the first light source and generate images of the first light source on the lens focal surface above the intersection line, the lens being configured to receive and transmit the light directed by the reflector, the ellipse comprising the side edge of the reflector having a second focal point between the lens focal surface and the lens.

2. The projector-type vehicle headlamp according to claim 1, wherein the light at the focal surface passing beneath the intersection line of the focal surface with the reference plane is transmitted by the lens to be above the optical axis of the lens.

3. The projector-type vehicle headlamp according to claim 2, wherein the first focal point of the ellipse is located in a middle of a closest edge of the light emitting surface of the first light source, the closest edge of the light emitting surface being an edge closest to the focal surface.

4. The projector-type vehicle headlamp according to claim 1, wherein the headlamp further comprises a second light source and a second optics, these two being configured to direct light from the second light source via the second optics towards a focal point of the lens within the focal surface and on the optical axis.

5. The projector-type vehicle headlamp according to claim 4, wherein a light emitting surface of the second light source faces the second optics, and the second light source is arranged to be farer away from the first optics than the first light source.

6. The projector-type vehicle headlamp according to claim 5, wherein the first light source is arranged outside of paths traversed by the light from the second light source via the second optics to the lens.

7. The projector-type vehicle headlamp according to claim 1, wherein the reference plane has an angle of 0 degrees with respect to the horizontal plane.

8. The projector-type vehicle headlamp according to claim 1, wherein the reference plane has an angle of 45 degrees with respect to the horizontal plane.

9. The projector-type vehicle headlamp according to claim 1, wherein the light received by the lens has been reflected at most once by the reflector before being received by the lens.

10. The projector-type vehicle headlamp according to claim 1, wherein the light emitted by the first light source is emitted below the optical axis of the lens.

* * * * *